US011974636B2

(12) United States Patent
Epstein

(10) Patent No.: US 11,974,636 B2
(45) Date of Patent: May 7, 2024

(54) METHOD AND ARTICLE FOR FORMING A FOOT INSOLE EXHIBITING A PINCHED EDGE PROFILE

(71) Applicant: David Epstein, Pleasant Ridge, MI (US)

(72) Inventor: David Epstein, Pleasant Ridge, MI (US)

( * ) Notice: Subject to any disclaimer, the term of this patent is extended or adjusted under 35 U.S.C. 154(b) by 73 days.

(21) Appl. No.: 17/592,628

(22) Filed: Feb. 4, 2022

(65) Prior Publication Data

US 2022/0264991 A1 Aug. 25, 2022

Related U.S. Application Data

(60) Provisional application No. 63/151,870, filed on Feb. 22, 2021.

(51) Int. Cl.

| | |
|---|---|
| ***A43B 7/14*** | (2022.01) |
| ***A43B 17/00*** | (2006.01) |
| ***A43D 95/00*** | (2006.01) |

(52) U.S. Cl.

CPC ..... *A43B 7/14* (2013.01); *A43B 17/006* (2013.01); *A43D 95/00* (2013.01)

(58) Field of Classification Search

None

See application file for complete search history.

(56) References Cited

U.S. PATENT DOCUMENTS

| | | | | |
|---|---|---|---|---|
| 4,823,483 | A * | 4/1989 | Chapnick | A43B 17/14 36/43 |
| 6,101,743 | A | 8/2000 | Brown | |
| 7,360,325 | B2 * | 4/2008 | Chen | A43B 7/142 36/44 |
| 7,451,555 | B1 * | 11/2008 | Lakic | A43B 13/206 36/43 |
| 8,832,969 | B2 * | 9/2014 | Orvitz | A43B 13/12 36/180 |
| 9,119,440 | B2 | 9/2015 | Lagneau et al. | |
| 10,470,522 | B2 * | 11/2019 | Jacobsen | B29D 35/08 |
| 2001/0001351 | A1 * | 5/2001 | Dieckhaus | A43B 7/141 36/44 |
| 2012/0090198 | A1 * | 4/2012 | Stratten | A43B 13/386 36/44 |
| 2014/0245631 | A1 * | 9/2014 | Joseph | A43B 7/141 12/142 N |
| 2015/0257487 | A1 | 9/2015 | Ruiz et al. | |
| 2016/0021978 | A1 * | 1/2016 | Bae | A43B 7/28 36/44 |
| 2016/0286897 | A1 * | 10/2016 | Louko | B29D 35/14 |
| 2017/0095037 | A1 * | 4/2017 | Stratten | A43B 13/386 |
| 2017/0202301 | A1 * | 7/2017 | Amis | A43B 5/02 |
| 2020/0113277 | A1 * | 4/2020 | Davis | A43B 13/127 |
| 2021/0000218 | A1 * | 1/2021 | Ophir | A43B 7/1435 |

* cited by examiner

*Primary Examiner* — Jila M Mohandesi

(74) *Attorney, Agent, or Firm* — Dinsmore & Shohl LLP

(57) ABSTRACT

An orthotic support insole having a body including each of an uppermost anti-microbial lining, an intermediate foam layer, a rigid stabilizer insert and a bottom-most thermo-formable foam layer. An extending edge of the body corresponds to at least a heel cup and intermediate sides being fused along an outer perimeter edge to prevent delamination. The body includes a non-standard thickness along an axial length thereof and the fused perimeter edge extends to a location proximate a forward extending edge portion of the body.

3 Claims, 10 Drawing Sheets

METHOD AND ARTICLE FOR FORMING A FOOT INSOLE EXHIBITING A PINCHED EDGE PROFILE

CROSS REFERENCE TO RELATED APPLICATIONS

The present application claims the priority of U.S. Ser. No. 63/151,870 filed Feb. 22, 2021.

FIELD OF THE INVENTION

The present invention relates generally to a shoe insole or insert. More specifically, the present invention discloses a novel orthotic support insole which incorporates each of an uppermost anti-microbial lining, an intermediate foam layer, a rigid stabilizer insert and a bottom-most thermos-formable foam layer. The new design provides the combined features of achieving a non-standard thickness along an axial length of the insole during its formation, in combination with fusing of the edges of the multiple layers at least along the heel cup and sides which also prevents delamination of the multiple layers.

BACKGROUND OF THE INVENTION

The prior art is documented with examples of orthotic insoles. A first example of this is the rigid insole depicted in FIGS. 1 and 2 which teaches a multi-layer arrangement with each of an uppermost anti-microbial lining 12, an intermediate foam layer 14, a rigid stabilizer insert (hidden in each of FIGS. 1-4 and as depicted separately at 16 in FIG. 6) and a bottom-most thermo-formable foam layer 18.

Brown, U.S. Pat. No. 6,101,743, teaches a thin orthotic insert having a rigid rearfoot plate and a flexible forefoot cushion which are joined together without requiring a separate top cover. A connection is formed by a slot at a forward edge of the plate which receives and holds a rearward edge of the cushion layer. The rearfoot plate may be formed as a laminate structure, with forward edges of the upper and lower laminate layers being separated to form the wall portions above and below the slot. A spacer is inserted between the edges of the layers and then withdrawn after molding/curing.

Davis, US 2020/0113277, teaches a systems and methods directed to footwear with adaptations for improved usability. The article includes a multi-layered midsole configured to provide improved support and comfort during use, while also providing anti-microbial protection to the user's foot.

U.S. Pat. No. 9,119,440, to Lagneau et al., teaches an insole article of footwear including a deformable cavity filled with a compressible, fluid-permeable member material to which are communicated each of fluid inlets and outlets. The thickness of the principal portion in its non-deformable state is substantially constant, with the possible exception of the perimeter of the cavity and/or the fluid inlet and outlet.

SUMMARY OF THE PRESENT INVENTION

The present application discloses an orthotic support insole having a body including each of an uppermost anti-microbial lining, an intermediate foam layer, a rigid stabilizer insert and a bottom-most thermo-formable foam layer. An extending edge of the body, corresponding to at least a heel cup and intermediate sides, is fused along an outer perimeter edge to prevent delamination. The body includes a non-standard thickness along an axial length thereof and the fused perimeter edge extends to a location proximate a forward extending edge portion of the body.

A corresponding process for forming an orthotic support insole is provided and which includes the steps of forming a body including each of an upper layer, a rigid stabilizer insert and a bottom-most thermo-formable foam layer, along with pinching or fusing together an extending edge of the body corresponding to at least a heel cup and intermediate side locations to prevent delamination. Additional steps include the step of forming the upper layer further including forming, in combination, forming each of an upper lining and an intermediate foam layer.

Other steps include providing a die with right and left cavities for forming a pair of the bodies, with the step of forming the body further including heat molding the bottom thermoformable layer from an EVA material. Additional steps include adhesively securing the rigid stabilizer insert to the bottom EVA material and heating the upper layer prior to insertion into the die with the bottom EVA material and attached rigid insert. Also provided is the step of die cutting the finished bodies.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 2:
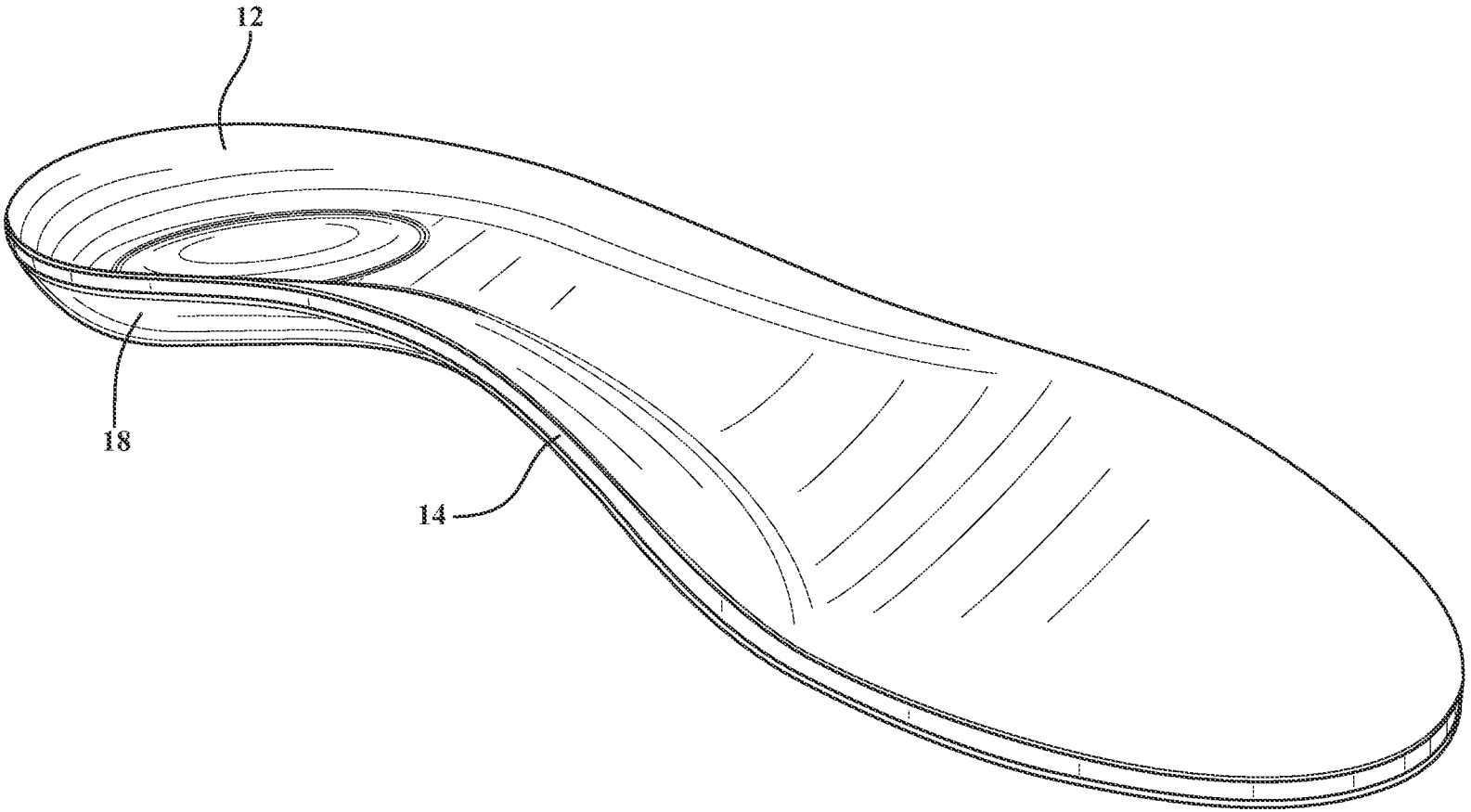
FIG. 2 PRIOR ART
FIG. 2 is a rotated view of the insole in FIG. 1.
Figure 3:
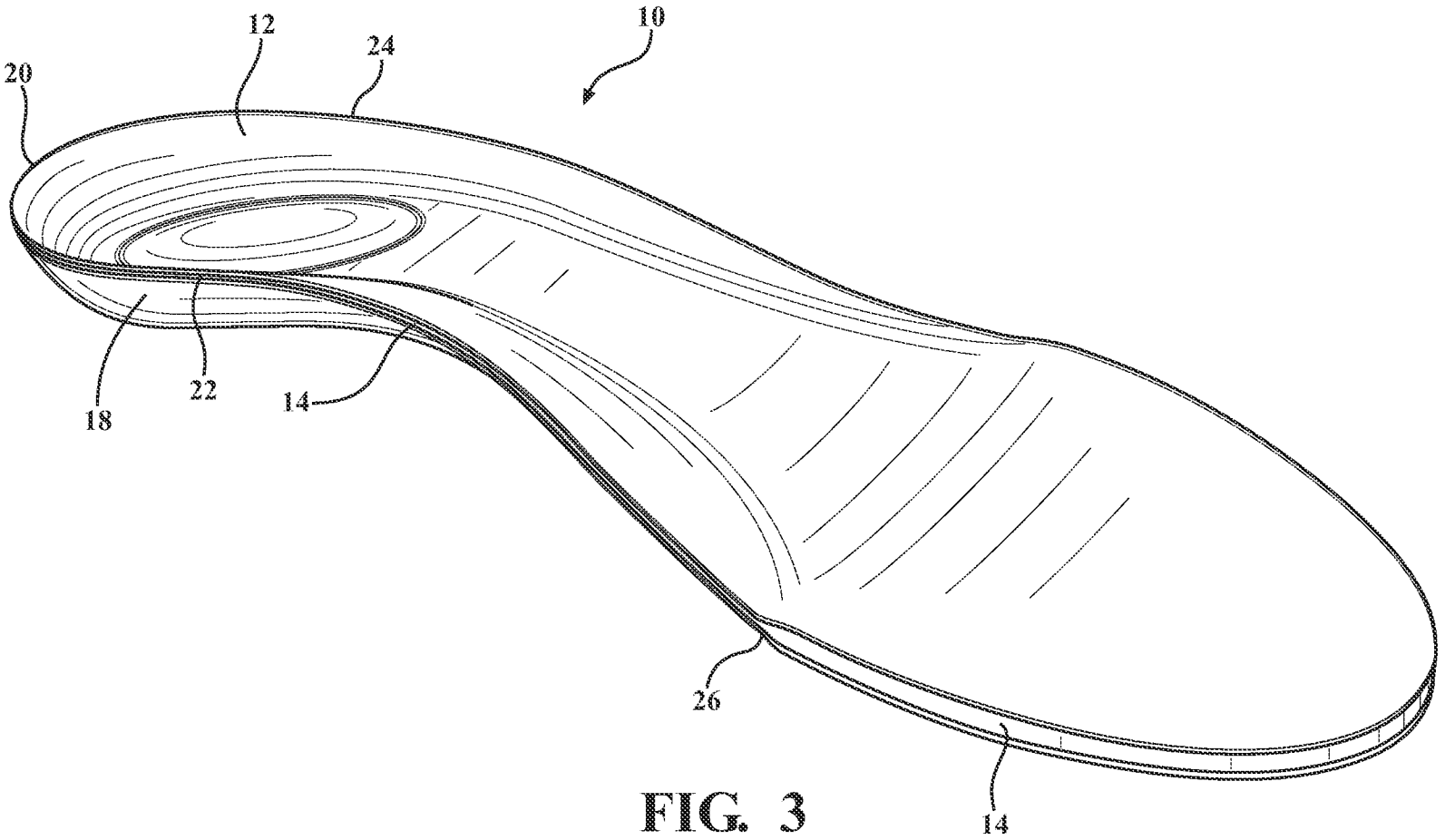
FIG. 3 is an illustration of a rigid insole insert according to a non-limiting embodiment of the present invention.

With reference to the attached illustrations, in particular FIG. 3 et. seq., the present invention discloses a novel orthotic support insole (see as referenced at 10 in FIGS. 3-4 below), and which (similar to the Prior Art view of FIGS. 1-2) again incorporates each of an uppermost anti-microbial lining 12, an intermediate foam layer 14, a rigid stabilizer insert (hidden in each of FIGS. 1-4 and as depicted separately at 16 in FIG. 5) and a bottom-most thermo-formable foam layer 18.

As further described below, the novel design provides the combined features of achieving a non-standard thickness along an axial length of the insole during its formation (such as which is assisted by the corresponding formation process in which the mating dies (see as subsequently described in FIGS. 7 and 10) can be applied with varying, heat and force/pressure application in order to achieve a non-uniform thickness in either of axial or lateral extending directions. The formation of the insole again occurs in combination with fusing of the edges of the multiple layers at least along the heel cup and sides, and as shown in FIGS. 3-4 for the full size insole and in FIG. 8 for the three quarter sized insole, and which further assists in preventing delamination of the multiple layers.

Figure 1:
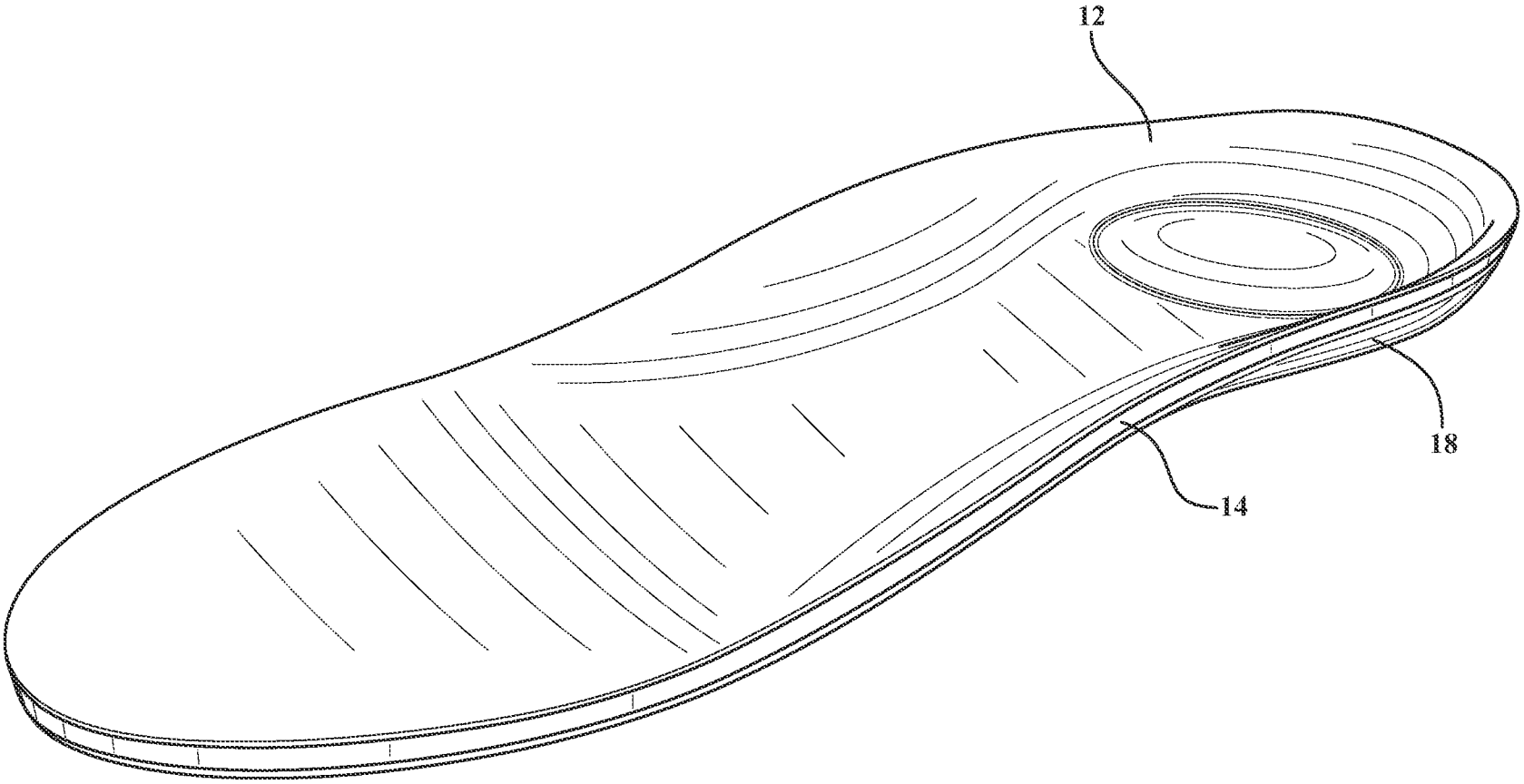
FIG. 1 PRIOR ART
FIG. 1 is an illustration of a rigid insole as known in the prior art.

FIG. 1 again is an illustration of a rigid insole as known in the Prior Art, with FIG. 2 providing an enlarged and rotated view of the insole in FIG. 1. Comparing to the example of the present invention at 10 in FIGS. 3-4 (which again depicts a full size rigid insole), the prior art design of FIGS. 1-2 depicts the upper lining 12, intermediate foam 16 and lower-most thermo-formable foam 18 layers in a spaced and non-pinched arrangement which can lead to delamination of the insole.

Figure 4:
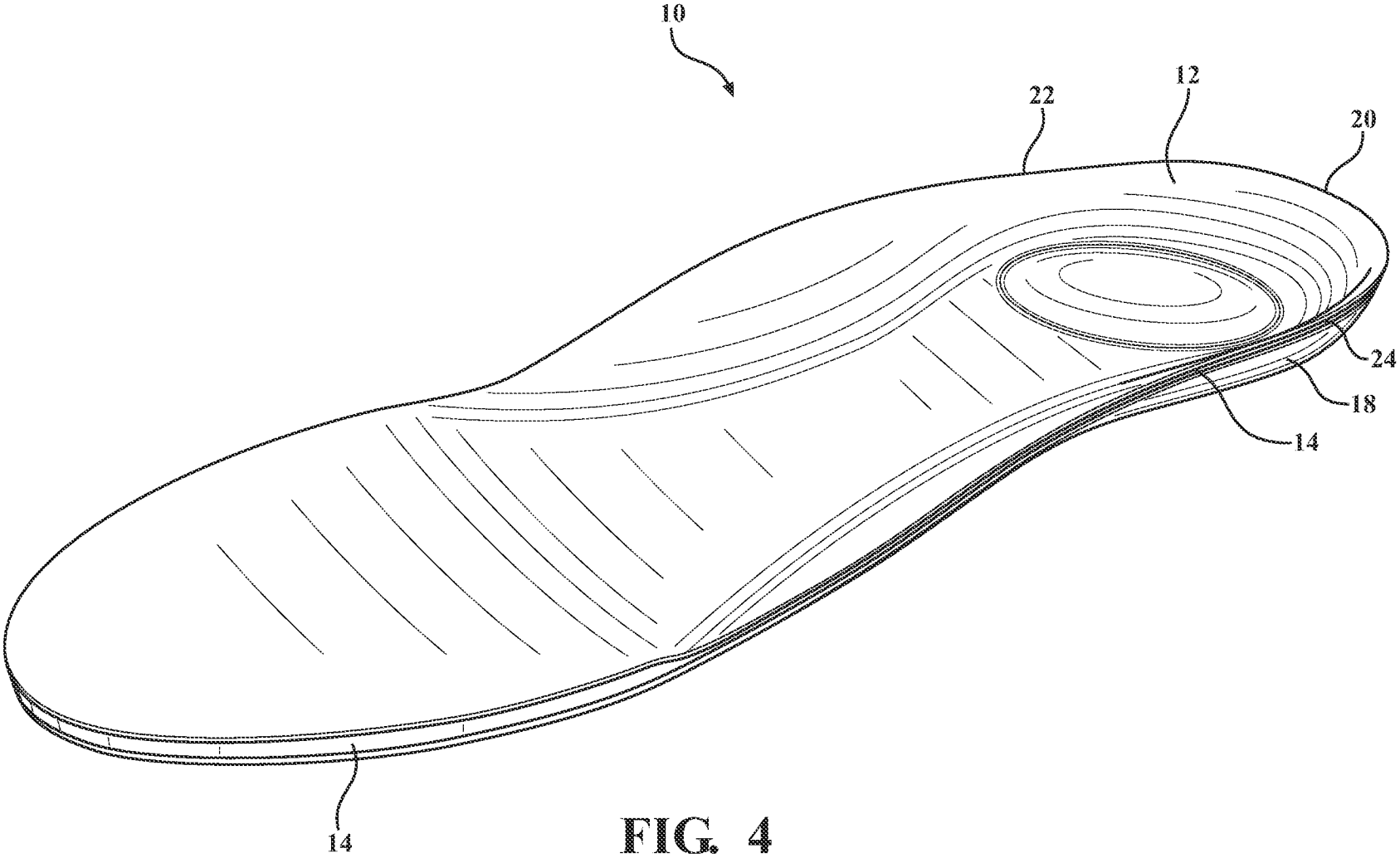
FIG. 4 is an enlarged and rotated view of the insole of FIG. 3.

In comparison, FIGS. 3-4 depict the preferred arrangement of the pinched edge profile according to a non-limited preferred embodiment 10, it being understood that a further envisioned embodiment the entire outer perimeter of the insole can exhibit a continuous pinched edge. Alternatively, the pinched edge locations can be limited to any of the heel cup location (corresponding to location 20 in FIGS. 3-5), rear extending side locations (further referenced at 22 and 24), as well as a forward contoured lateral arch location (see as shown up to location 26 in FIG. 3, and which can be extended to a forward-most position as desired to pinch the intermediate foam layer 14).

Figure 6:
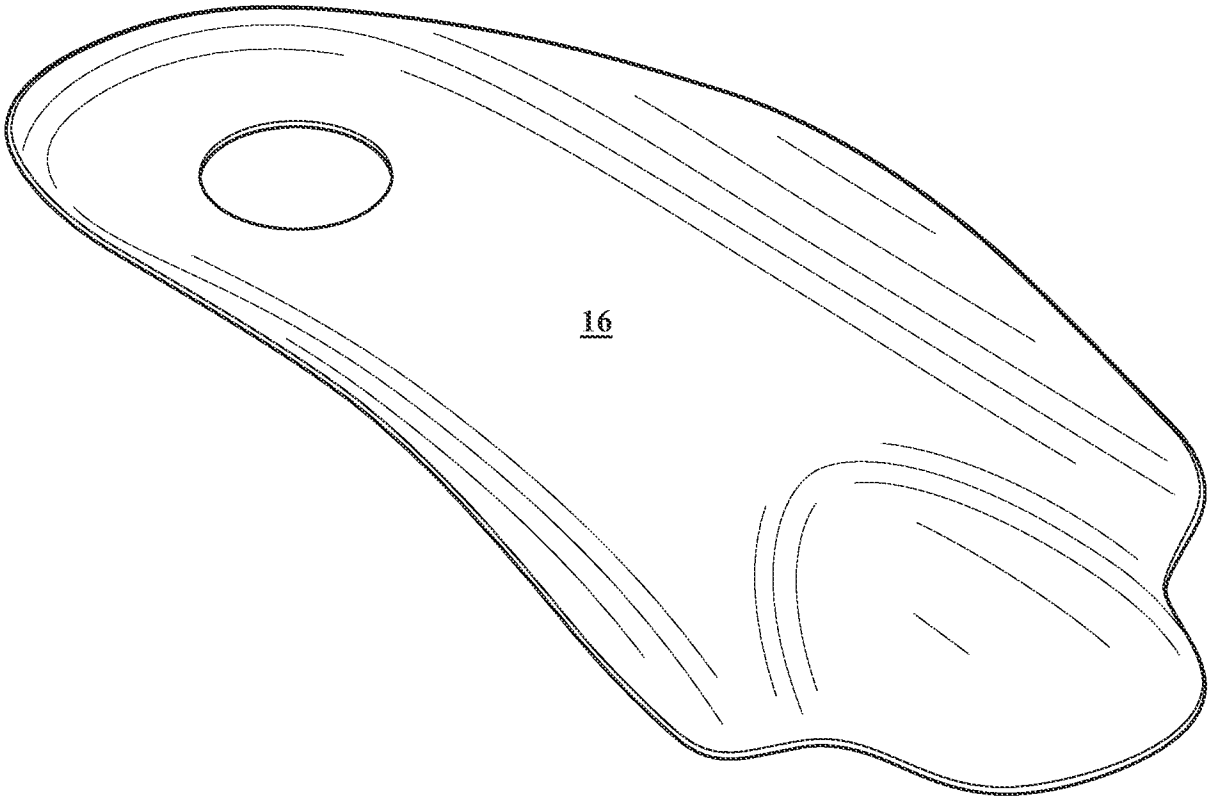
FIG. 6 is an illustration of a rigid stabilizer insert of the rigid insole of FIG. 3 and which is arranged at an intermediate location between a first sub-combination of an uppermost anti-microbial lining and intermediate foam layer on an upper side of the rigid insert and the thermo-formable foam layer defining a bottom-most layer.

FIG. 6 again provides an illustration of a rigid stabilizer insert 16 of the rigid insole of FIG. 3 which is shaped to conform to the intermediate and rear perimeter of the lining 12, intermediate form 16 and lower most foam layer 18. The rigid insert 16 is arranged at an intermediate location between a first sub-combination of the uppermost anti-microbial lining 12 and intermediate foam layer 14 on an upper side of the rigid insert 16, and with the thermo-formable foam layer 18 defining a bottom-most layer on a reverse lower side of the rigid insert 16. As has been previously explained, the rigid insole can be reconfigured to include any other size, such as a three quarter size version.

Figure 7:
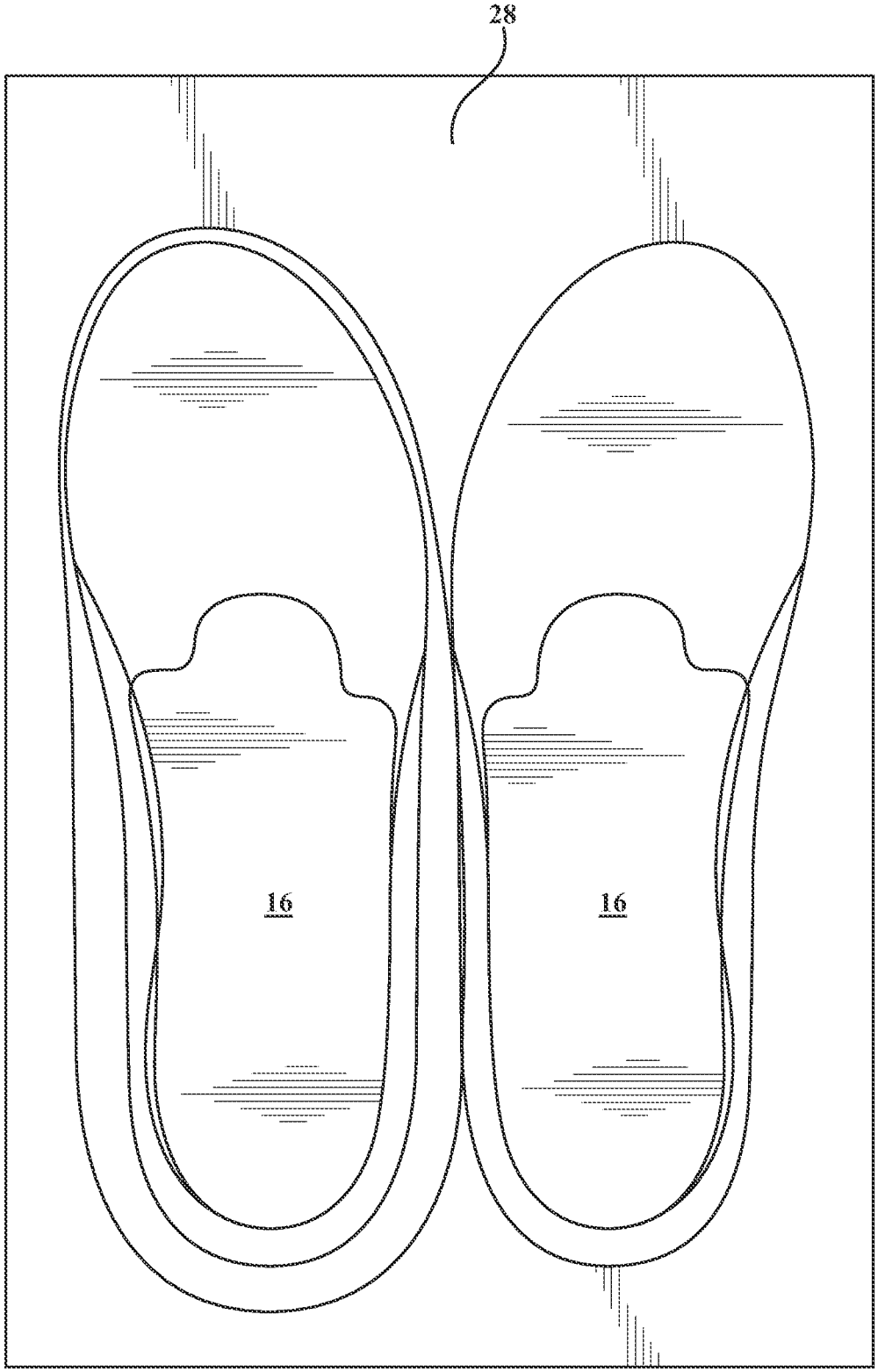
FIG. 7 is an illustration of a forming die utilized in a mold process for forming the rigid insole insert of FIG. 3.

Proceeding to FIG. 7, an illustration is provided at 28 of a representative forming die (such as constituting a lower half of a pair of mating and opposing upper and lower dies) which is utilized in a mold process for forming the rigid insole insert 10 of FIG. 3. The die 28 includes both right and left foot cavities for forming a pair of bodies, each incorporating a rigid insert shell 16 as shown. As is further understood, the forming dies can again be provided as pairs, with other variants including upper and lower individual die halves provided in a sandwiching fashion in order to define an interior space corresponding to the shape and dimension of the rigid insole article to be produced.

The present invention also provides a novel process for forming the rigid insole article utilizing the die template 28. Without limitation, any die slide or pick and place processes can be utilized with the die template according to any combination in order to create the finished rigid insole article.

Existing forming techniques for producing such as the prior art rigid insole of FIGS. 1-2 include heat molding a base polymer material (such as an EVA or ethylene vinyl acetate which is an elastic co-polymer exhibiting similar properties to rubber). This corresponds generally to the thermo-formable foam layer 18 previously described.

Additional conventional steps include gluing the plastic rigid shell (also termed the rigid insert 16) to the EVA base polymer material 18. Subsequent steps include gluing a sectioned piece of 3-5 mm EVA sheet, such as corresponding to the uppermost lining 12 alone or in combination with the inner foam sheet or layer 14, following which a cold pressing mold technique is employed for reinforcing the lamination of the three layers together. Final steps include die-cutting the combination from the completed sheet.

The novel forming process, such as drawing from the die template of FIG. 7, repeats the initial steps of heat molding the polymer base material 18 and adhesively securing (gluing) the rigid insert 16 to the base polymer material 18. An EVA sheet (such as without limitation exhibiting 6 mm in thickness) is separately heated to a semi-molten state and is then placed, along with the combination base 18 and attached plastic insert/shell 16 in the mold for reshaping, following which a die cut procedure is employed for removing the outer most skirt material from the finished profile. The forming process of the present invention also provides the ability of varying the application of pinching pressure at certain locations within the sandwiched molds, this in order to modify the thickness and profile of the completed rigid insert.

Figure 8:
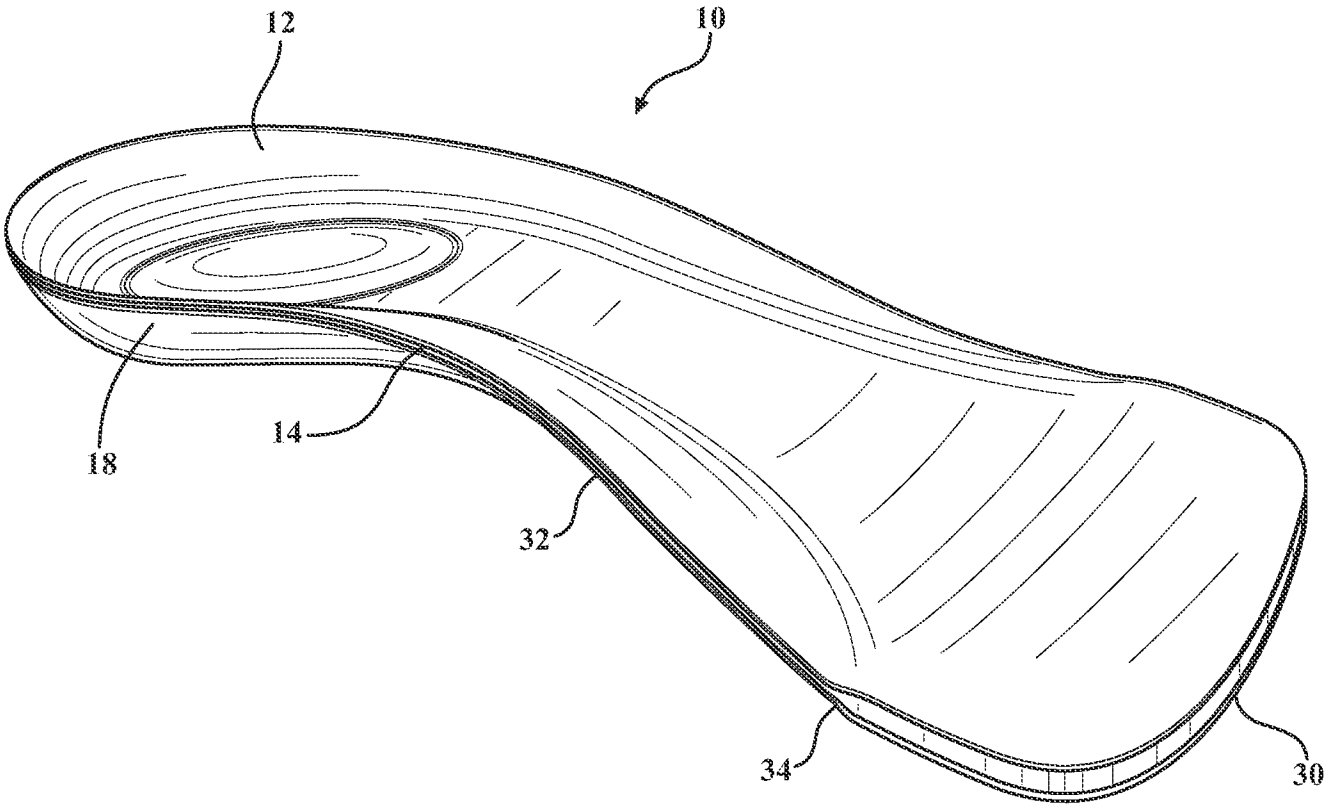
FIG. 8 is perspective view similar to FIG. 3 of a ¾ size rigid insole according to a further non-limiting embodiment of the present invention.

Proceeding to FIG. 8, a perspective view similar to FIG. 3 is shown of a ¾ size rigid insole according to a further non-limiting embodiment of the present invention. The construction of the insole is substantially the same as the full sized variant of FIGS. 3-5, with the exception that the forward edge (see at 30) is shortened to a level front edge or abbreviated in order to terminate short of the upper thymus and shoulder bones (not shown) of the user's foot underside and from which extend the toes.

Figure 5:
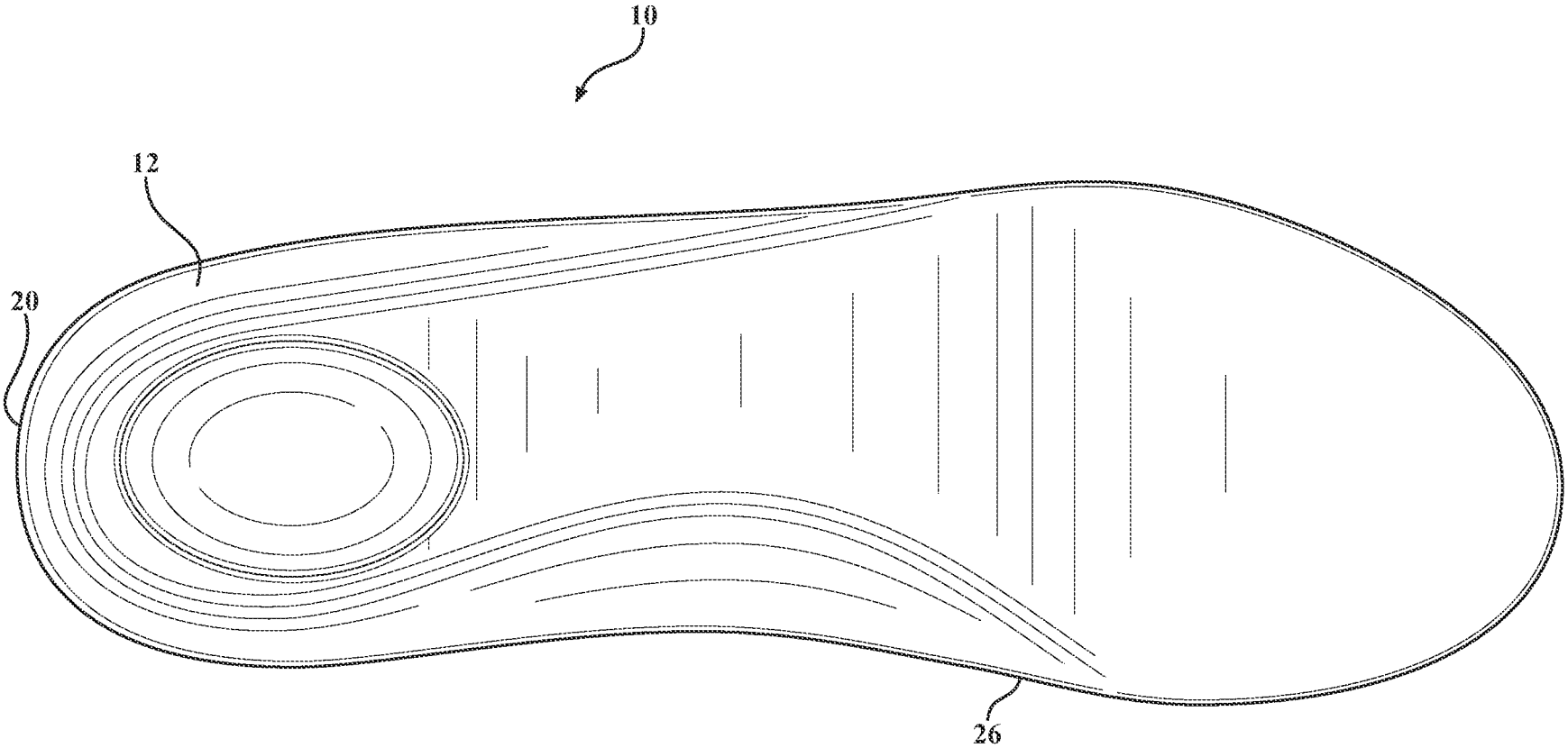
FIG. 5 is a top plan view of the insole of FIG. 3.
Figure 9:
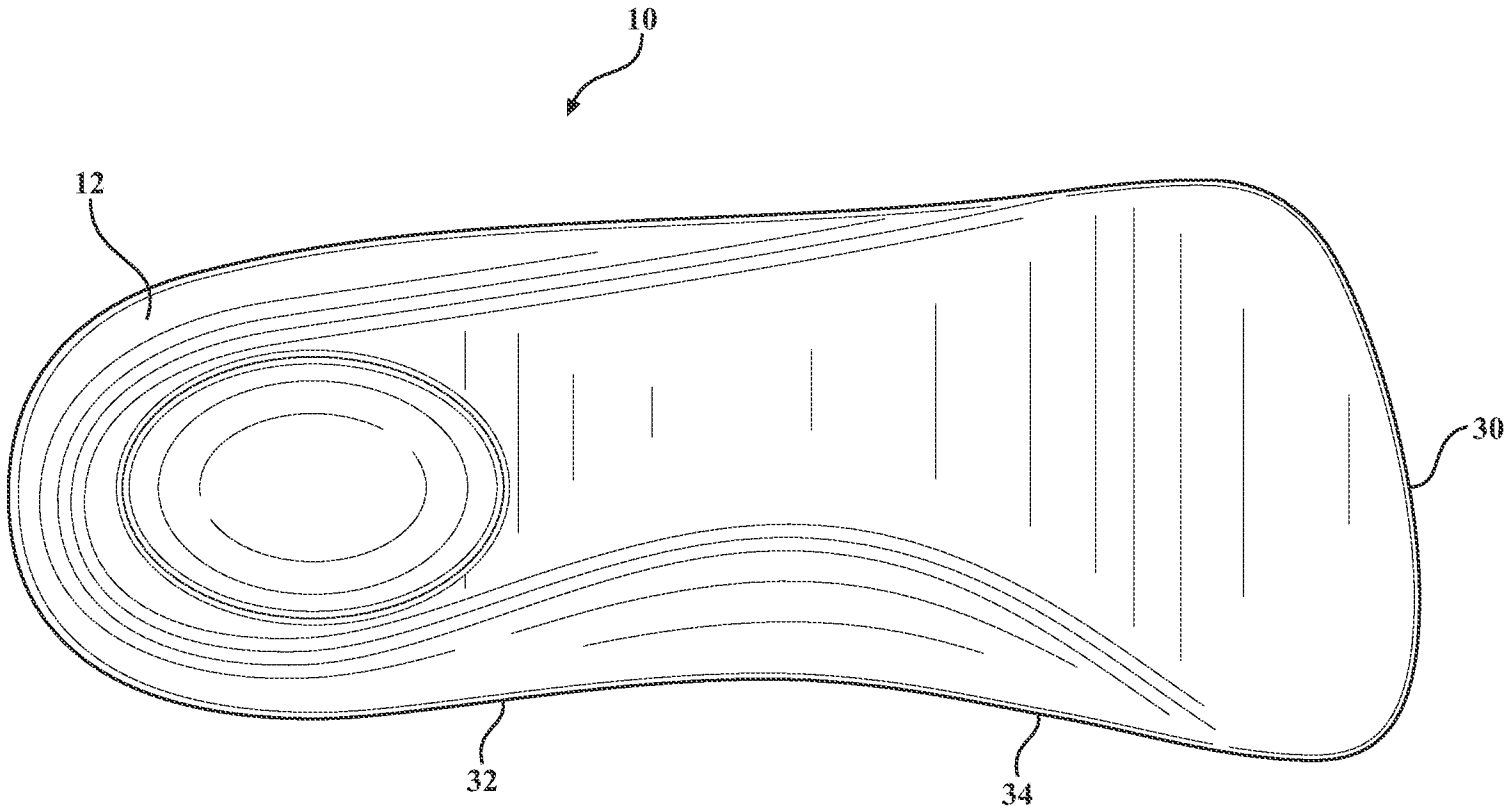
FIG. 9 is a top plan view of the insole of FIG. 8.
Figure 10:
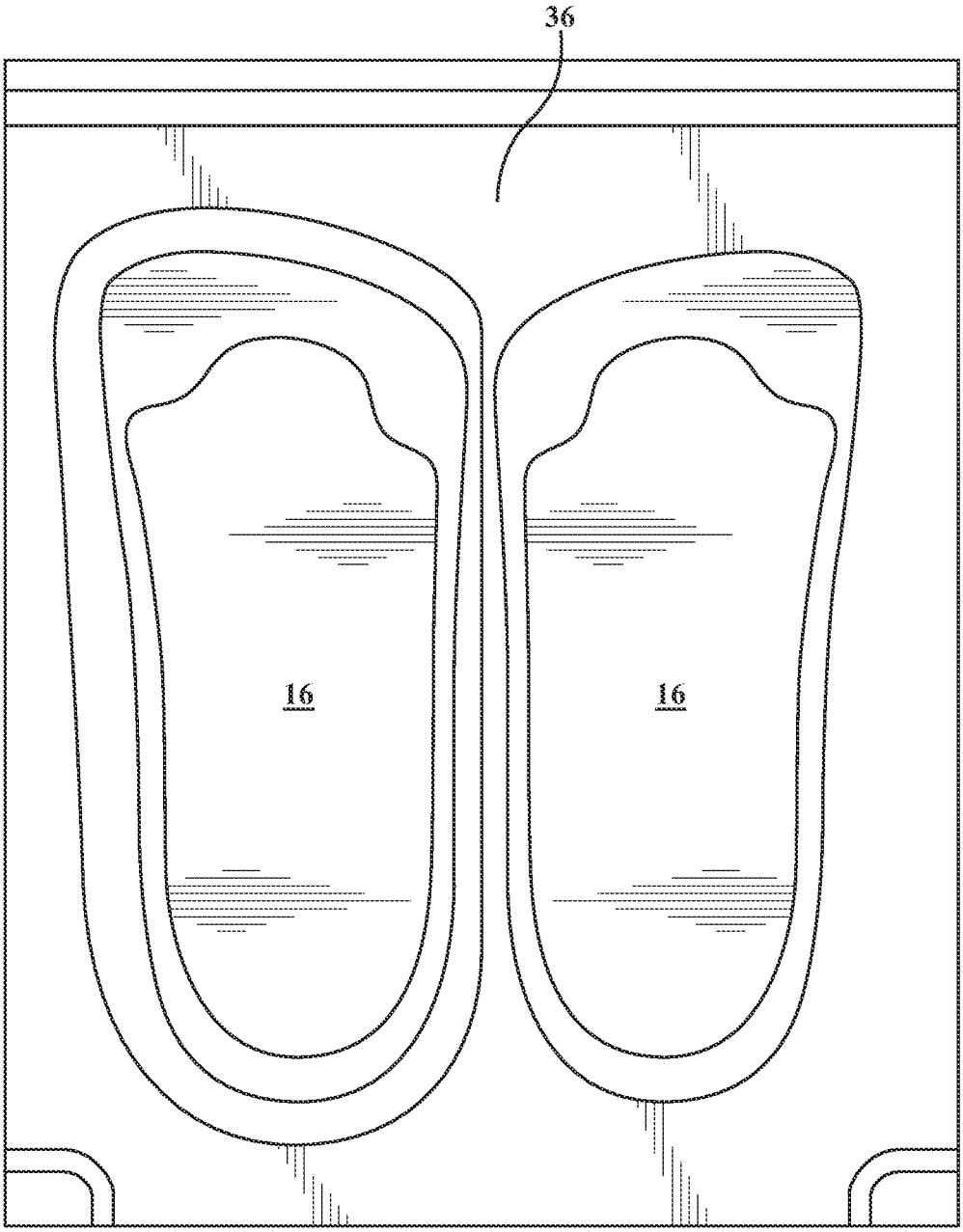
FIG. 10 is an illustration of a forming die utilized in a mold process for forming the ¾ size rigid insole insert of FIG. 8.

As with the initial variant of FIGS. 3-5, the ¾ sized insole includes a narrowed and pinched outer edge (see as shown at side edge location 32) which extends along each of the opposite sides and interconnecting rear edge forming the outer perimeter of the article. As further shown, a transition location (at 34) is depicted in FIG. 8 between the pinched side location 32 and the forward edge 30. As previously described, a transition location 34 is provided between the pinched 32 and non-pinched 30 sections and can be varied. FIG. 9 is a top plan view of the insole of FIG. 8 and FIG. 10 is an illustration of a forming die 36 (similar to that previously shown at 28 in FIG. 7 for the full size insole) and which is again utilized in a mold process for forming the ¾ size rigid insole insert of FIG. 8.

Having described my invention, other and additional preferred embodiments will become apparent to those skilled in the art to which it pertains, and without deviating from the scope of the appended claims. This can include the provision of a corresponding method or process for creating the multi-layer rigid insole which can include formation of the pinched edges as shown in FIGS. 3-4, as well as the ability to vary the overall thickness of the multi-layer insole in either of the axial or lateral directions.

The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The foregoing disclosure is further understood as not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosure. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

The invention claimed is:

1. An orthotic support insole, comprising:

a body including each of an uppermost anti-microbial lining, an intermediate foam layer, a rigid stabilizer insert and a bottom-most thermo-formable foam layer; and an extending outer perimeter edge of the body having a first forward extending thickness and being fused along each of a heel cup and intermediate sides up to forward lateral arch locations on opposite sides according to a second narrower extending thickness in order to define a pinched profile to prevent delamination of said layers.

2. The insole of claim 1, said body further comprising a non-standard thickness along an axial length thereof.

3. The insole of claim 1, further comprising said fused perimeter edge extending to a location proximate a forward extending edge portion of said body.

* * * * *